US010632332B2

(12) United States Patent
Anderson et al.

(10) Patent No.: US 10,632,332 B2
(45) Date of Patent: Apr. 28, 2020

(54) FALL RESTRICTION DEVICE

(71) Applicant: Bashlin Industries, Inc., Grove City, PA (US)

(72) Inventors: Preston L Anderson, Franklin, PA (US); Bradley S McGill, Grove City, PA (US)

(73) Assignee: Bashlin Industries, Inc., Grove City, PA (US)

( * ) Notice: Subject to any disclaimer, the term of this patent is extended or adjusted under 35 U.S.C. 154(b) by 114 days.

(21) Appl. No.: 14/607,424

(22) Filed: Jan. 28, 2015

(65) Prior Publication Data

US 2016/0213961 A1 Jul. 28, 2016

(51) Int. Cl.
*A62B 35/00* (2006.01)
*A63B 27/00* (2006.01)
*A63B 29/00* (2006.01)

(52) U.S. Cl.
CPC ..... *A62B 35/0075* (2013.01); *A63B 27/00* (2013.01); *A63B 29/00* (2013.01)

(58) Field of Classification Search
CPC ..... A62B 35/0075; A62B 35/68; A63B 27/00; A63B 29/00
See application file for complete search history.

(56) References Cited

U.S. PATENT DOCUMENTS 4,253,218 A * 3/1981 Gibbs ..... A62B 1/14 182/5
4,542,884 A * 9/1985 Dodge, Jr. ..... A62B 1/14 254/391
5,141,074 A * 8/1992 Sulowski ..... A62B 35/0031 182/133
5,184,696 A * 2/1993 Meed ..... A62B 35/0068 182/133
6,056,086 A * 5/2000 Gortan ..... A62B 1/14 182/197
D604,912 S * 11/2009 Paul ..... D29/124
8,225,905 B2 * 7/2012 Delaittre ..... A62B 1/14 182/190
8,398,134 B1 * 3/2013 Mortensen ..... B66F 19/00 248/925
8,464,832 B1 * 6/2013 Rullo ..... A62B 35/0037 182/192

(Continued)

OTHER PUBLICATIONS

Bashlin Industries, Inc., 77BCS Series: Pole Lariat; website printouts from http://www.bashlin.com/77bcs-pole-lariat.html; date visited Jan. 28, 2015; publisher Bashlin Industries, Inc.; copyright 2014-15 Bashlin Industries, Inc.; Grove City, Pennsylvania; USA; 2 pages.

*Primary Examiner* — Katherine W Mitchell
*Assistant Examiner* — Candace L Bradford
(74) *Attorney, Agent, or Firm* — Metz Lewis Brodman Must O'Keefe LLC

(57) ABSTRACT

A fall restriction device is provided that includes a rope and a connector that has a rope connector base. A latch is retained by the rope connector base. The connector has a rope connector with an aperture and the rope is disposed through the aperture. The rope connector has an engaged position in which the rope connector is retained to the rope connector base. The rope connector is moved from the engaged position by being moved along the rope connector base and by being rotated relative to the rope connector base.

19 Claims, 14 Drawing Sheets

(56) References Cited

U.S. PATENT DOCUMENTS

| | | | | |
|---|---|---|---|---|
| 8,887,866 | B2 * | 11/2014 | Petty | 182/133 |
| 2004/0163898 | A1 * | 8/2004 | Bergquist | A62B 1/14 188/65.2 |
| 2009/0188753 | A1 * | 7/2009 | Liang | A63B 27/00 182/133 |
| 2010/0051382 | A1 * | 3/2010 | Schlief | A62B 35/0006 182/9 |
| 2010/0078261 | A1 * | 4/2010 | Watts | A62B 35/00 182/9 |
| 2010/0089694 | A1 * | 4/2010 | Paul | A62B 35/0068 182/9 |
| 2011/0214941 | A1 * | 9/2011 | Petty | A63B 27/00 182/9 |
| 2011/0290586 | A1 * | 12/2011 | Goldmann, II | A63B 27/00 182/3 |
| 2012/0205193 | A1 | 8/2012 | Patel et al. | |
| 2012/0292129 | A1 | 11/2012 | Seman | |

* cited by examiner

FALL RESTRICTION DEVICE

FIELD OF THE INVENTION

The present invention relates generally to a fall restriction device for use in holding an individual onto an object such as a utility pole. More particularly, the present application relates to a fall restriction device that has a connector that engages a rope of the device that can be easily and quickly removed and reattached.

BACKGROUND

Fall restriction devices are known to secure a climber to an object in order to prevent the climber from falling from the object. For example, fail restriction devices are used in the telecommunications and power transmission fields to secure a climber to a utility pole when the climber is climbing, descending, or remaining stationary thereon. The climber may need to get to the top of the utility pole in order to fix, remove, inspect, or install equipment. When climbing the utility pole, the worker may employ a pair of gaffs that are spikes attached to the boots of the worker that may be driven into the utility pole. The climber may also use a body belt that is worn by the user around his or her waist that is attached to the fall restriction device. With the fall restriction device, the body belt, and the gaffs, the user can climb, descend, and remain stationary on the utility pole.

When moving up or down a utility pole, it is often the case that obstructions such as equipment, lines, and other objects block the path of the climber. The climber must unhook or otherwise detach the fall restriction device in order to move the fall restriction device over or around such obstructions. Prior to such detachment, the climber will attach a secondary device, such as an adjustable pole strap or rope lanyard, onto the utility pole to ensure the climber does not fall when the primary fall restriction device is removed and reattached to negotiate around the object.

A tremendous amount of skill and dexterity must be employed by the climber when holding onto the utility pole high in the air and manipulating the primary fall restriction device and secondary device. The utility pole may be icy, or other weather conditions may persist that further hinder the climber doing his or her work. The climber will often be wearing thick rubber gloves to protect the climber's hands from contacting high voltage sources on the utility pole, and the use of thick gloves may make disengaging and reengaging components of the fall restriction device difficult. Hooks and other components of fall restriction devices may become caught on clothing of the user or on objects encountered when working on utility poles.

Fall restriction devices may include an inner rope that is generally located between the climber and the utility pole that functions to grab onto the utility pole should the climber fall. Hardware, such as hooks, connectors, and carabiners, may be located between the utility pole and the climber that is incorporated into the fall restriction device. In some instances, the hardware is located to the right or left side of the fall restriction device and has a tendency to pull the climber to one side or the other during use. Aside from being awkward, these asymmetrical fall restriction devices may cause the climber to fall or slip during use because pulling forces on the climber are not evenly distributed. As such, there remains room for variation and improvement within the art.

BRIEF DESCRIPTION OF THE DRAWINGS

A full and enabling disclosure of the present invention, including the best mode thereof, directed to one of ordinary skill in the art, is set forth more particularly in the remainder of the specification, which makes reference to the appended FIGS. in which.

Figure 1:
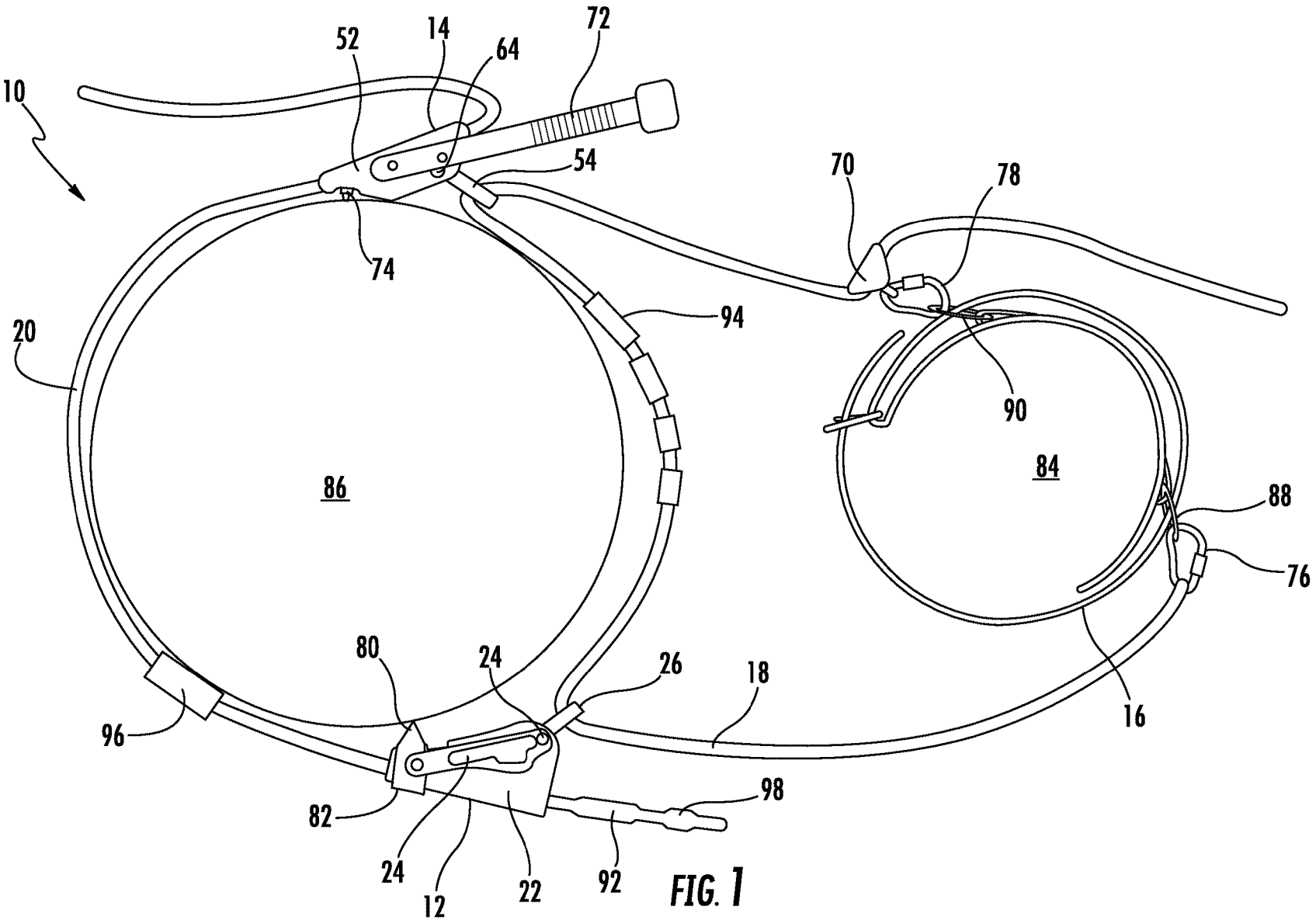
FIG. 1 is a top plan view of a fall restriction device in accordance with one exemplary embodiment.

Repeat use of reference characters in the present specification and drawings is intended to represent the same or analogous features or elements of the invention.

DETAILED DESCRIPTION OF REPRESENTATIVE EMBODIMENTS

Reference will now be made in detail to embodiments of the invention, one or more examples of which are illustrated in the drawings. Each example is provided by way of explanation of the invention, and not meant as a limitation of the invention. For example, features illustrated or described as part of one embodiment can be used with another embodiment to yield still a third embodiment. It is intended that the present invention include these and other modifications and variations.

It is to be understood that the ranges mentioned herein include all ranges located within the prescribed range. As such, all ranges mentioned herein include all sub-ranges included in the mentioned ranges. For instance, a range from 100-200 also includes ranges from 110-150, 170-190, and 153-162. Further, all limits mentioned herein include all other limits included in the mentioned limits. For instance, a limit of up to 7 also includes a limit of up to 5, up to 3, and up to 4.5.

The present invention provides for a fall restriction device 10 that may be used by a camber 84 when climbing an object, such as a tree or utility pole 86, to aid the climber 84 in both climbing and preventing falls. The fall restriction device 10 may be arranged in a symmetrical manner in order to aid the climber 84 when ascending the utility pole 86, and to provide for a more even distribution of weight and components on either side of the climber 84 when ascended onto the utility pole and working thereon. The fall restriction device 10 may also be provided with a connector 12 that allows for quick and convenient attachment and detachment of an inner rope 18 or outer rope 20 during ascent or descent. Attachment and detachment of the inner or outer ropes 18, 20 may be needed when the climber 84 encounters obstructions on the utility pole 86 that prevent him or her from moving past. The connector 12 may be arranged so that the climber 84 may effect attachment and disengagement even when the climber 84 is wearing thick gloves. The fall restriction device 10 may also include a rope grab 14 that can be used to adjust the holding length of one of the ropes 18 or 20, and that may be used as a handle for grasping by the user 84 when ascending or descending the utility pole 86.

One exemplary embodiment of the fall restriction device 10 is illustrated with reference to FIG. 1. Here, the climber 84 is wearing belt 16 around his or her waist that is attached thereon in a known manner. An inner rope 18 may be included but is located between the climber 84 and the utility pole 86. An outer rope 20 may extend generally around the far side of the utility pole 86 from the climber 84. The inner rope 18 and outer rope 20 may be connected to one another through use of a connector 12 and a rope grab 14. The climber 84 may grasp handles 72 and 92 in order to move the outer rope 20 higher or lower on the utility pole 86 in order to ascend and descend.

The belt 16 includes a pair of rings 88 and 90. The inner rope 18 is attached to the belt 16 through attachment to these two rings 88, 90. In this regard, the inner rope 18 has on one end a first carabiner 76 that engages the ring 88 and may be attached thereon. A rope attachment 70 is located at some point along the length of the inner rope 18. The rope attachment 70 is adjustable in that its position along the inner rope 18 can be moved. The climber 84 may adjust the position of the rope attachment 70 on the inner rope 18 and then may lock the position of the rope attachment 70 thereon so that its position does not move. The rope attachment 70 may have a cam or other mechanism that allows for attachment and detachment to the inner rope 18. Although described as employing a cam, it is to be understood that the rope attachment 70 may employ any type of lockable connection that allows for the position of the rope attachment 70 to be changed on the inner rope 18 and then to be locked in place where desired. Also, although described as being adjustable, it may be the case that the inner rope 18 is not used in conjunction with an adjustable rope attachment 70 but instead has a working length that is fixed. The rope attachment 70 has an aperture through which a second carabiner 78 is disposed that is in turn linked to the ring 90 on the belt 16. The extra length of the inner rope 18 that is not the working length that extends past the rope attachment 70 can be tied off if desired so that it does not interfere with the climber 84 when using the fall restriction device 10.

One or more protective sleeves 94 may be disposed around the inner rope 18 and positioned at one or more locations between the connector 12 and the rope grab 14. The protective sleeves 94 may function so as to keep the inner rope 18 from engaging the utility pole 86. As the utility pole 86 may have a rough surface, splinters, or other objects may engage the inner rope 18 and function to weaken or tear the inner rope 18. The protective sleeves 94 may thus help prevent damage to the inner rope 18 and extend the working life of the inner rope 18 by minimizing or eliminating damage caused to the inner rope 18 through contact with the surface of the utility pole 86. The inner rope 18 is disposed through apertures of the connector 12 and the rope grab 14. Although frictional forces may exist between these engagements, the inner rope 18 is not locked onto or otherwise affixed to the connector 12 and rope grab 14 such that the inner rope may slide through the apertures of the connector 12 and the rope grab 14.

The outer rope 20 may be made of a durable material because it will directly contact the utility pole 86 and will have pulling forces applied thereon that will drive it against the rough surface of the utility pole 86. The outer rope 20 may thus be made of a more durable material than that making up the inner rope 18. However, it is to be understood that in accordance with other exemplary embodiments that the inner rope 18 may be made of the same material as the outer rope 20, or may in fact be made of a more durable material than the outer rope 20. The handles 72 and 92 are positioned so as to be symmetrical about the utility pole 86 to achieve ease of use by the climber 84. The handle 72 may be a component that is attached to or integrally formed with the rope connector 14. The connector 12 may have a similar handle, or may have the handle as shown with reference to FIG. 1. Here, the outer rope 20 itself forms the handle 92. In this regard, the outer rope 20 extends through the connector 12 to the handle 92 and then loops back towards the connector 12 and passes back through the connector 12 and is then reattached to itself at the crimping 96. The looping of the outer rope 20 at the handle 92 may also be additionally secured through crimping 98. It is therefore the case that this looping of the outer rope 20 forms a handle 92 that along with handle 72 forms a symmetrical grasping arrangement for the climber 84.

The connector 12 has one or more spikes 80 that function to grip the utility pole 86. In a similar manner, rope grab 14 is provided with one or more spikes 74 that engage and dig into the utility pole 86. The spikes 74, 80 may be used to aid the climber 84 in grasping the utility pole 86 and along with the engagement of the outer rope 20 provide for a secure attachment of the fall restraint device 10 to the utility pole 86. However, it is to be understood that in other exemplary embodiments that the spikes 74, 80 need not be present.

The fall restriction device 10 can be detached when the climber 84 is on the utility pole 86 so that the climber 84 can navigate over an obstacle on the utility pole 86. In this regard, the connector 12 is made so as to be disengageable to allow the inner rope 18 to be disengaged from the outer rope 20 and consequently from other portions of the connector 12. Once the climber 84 has disengaged the fall restriction device 10 and moved past the obstacle, he or she may reattach the inner rope 18 back to the portions of the connector 12 and thus reassemble the fall restriction device 10 as shown in FIG. 1. The connector 12 is shown in an exploded view in accordance with one exemplary embodiment in FIG. 2. The connector 12 has a rope connector 26 that is shown with reference to FIG. 3. The rope connector 26 has a ring-shaped portion that defines an aperture 28. The inner rope 18 extends through the aperture 28 and can move relative to the rope connector 26. A base 34 extends from the ring-shaped portion of the rope connector 26. A first projection 36 extends from the base 34 at a 90 degree angle, and second projection 38 extends in an opposite direction from the first projection 36. The base 34, first projection 36, and second projection 38 are arranged so as to give an end of the rope connector 26 a T-shape. The first and second projections 36, 38 extend at a 90 degree angle from the base 34, and their directions of extension are oriented so as to be 90 degrees from an axis that extends through the aperture 28. Although shown as being circular in shape, the aperture 28 may have a shape other than a circle in accordance with other exemplary embodiments.

Figure 2:
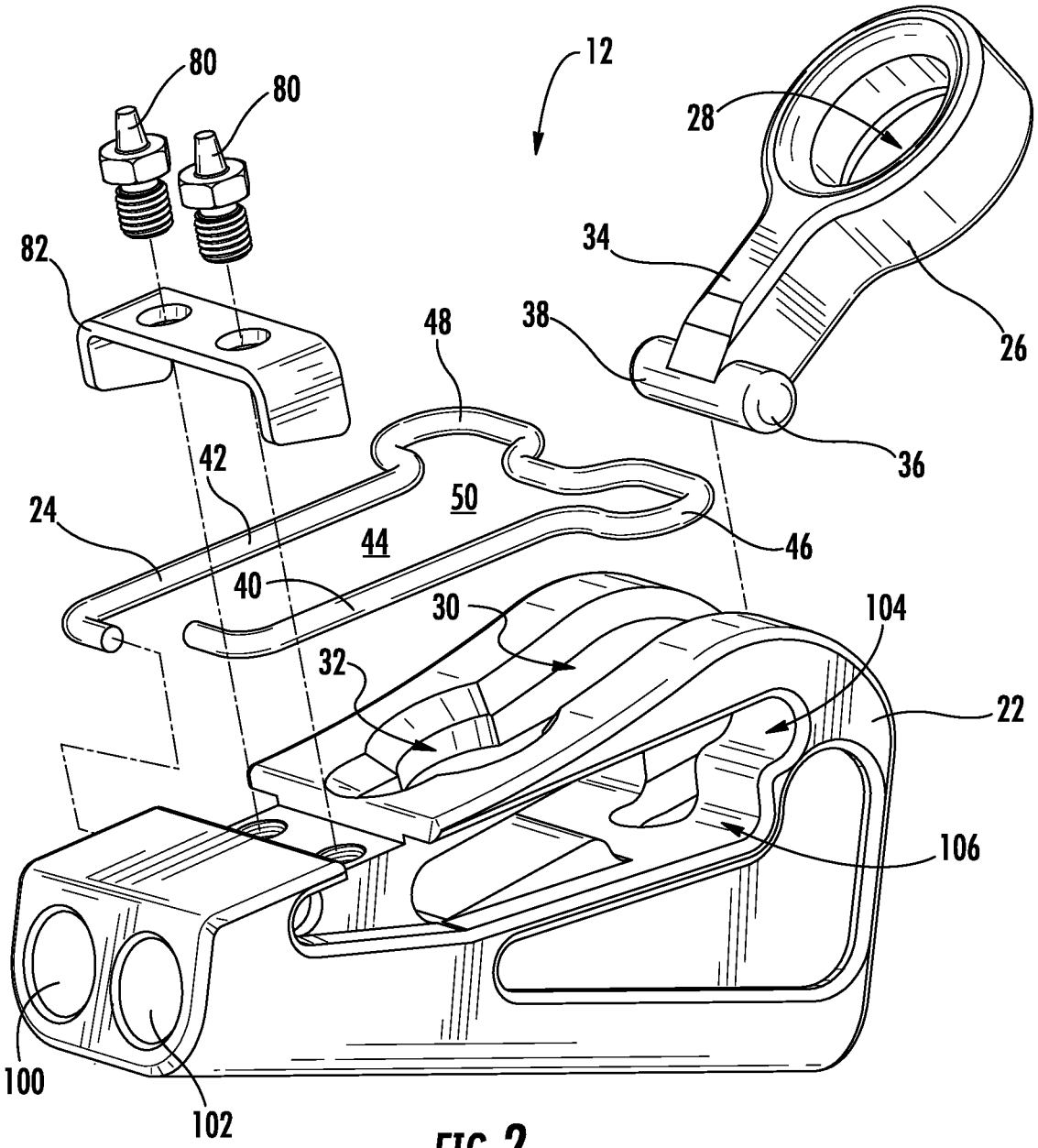
FIG. 2 is an exploded assembly view of a connector in accordance with one exemplary embodiment.
Figure 3:
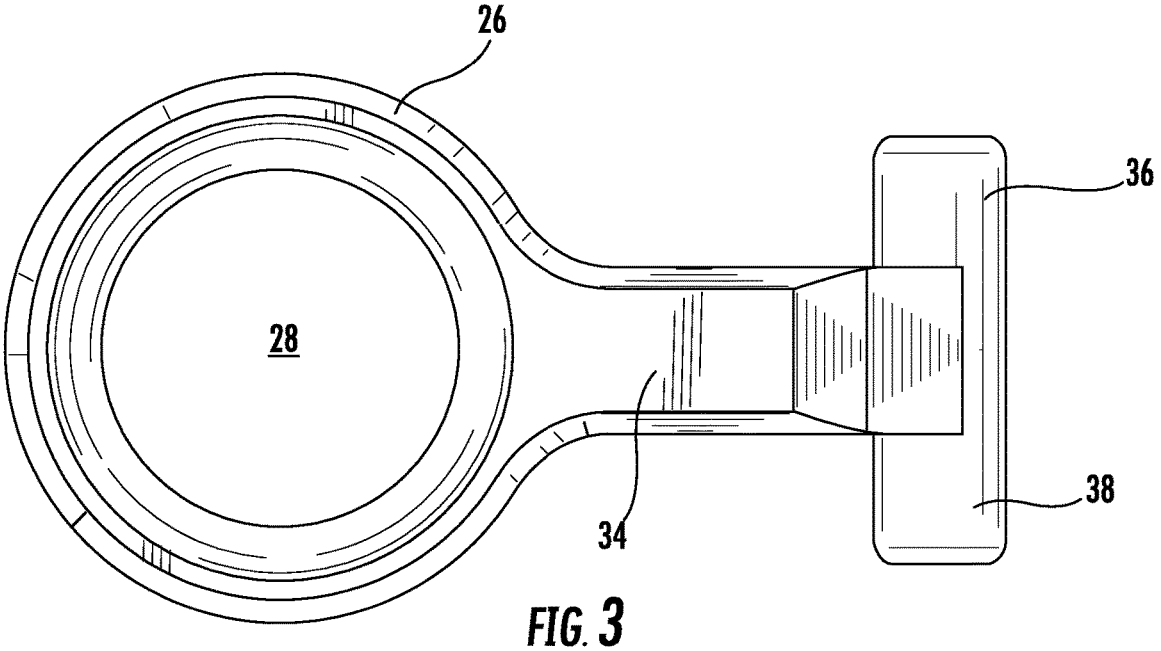
FIG. 3 is a top plan view of the rope connector of FIG. 2.
Figure 4:
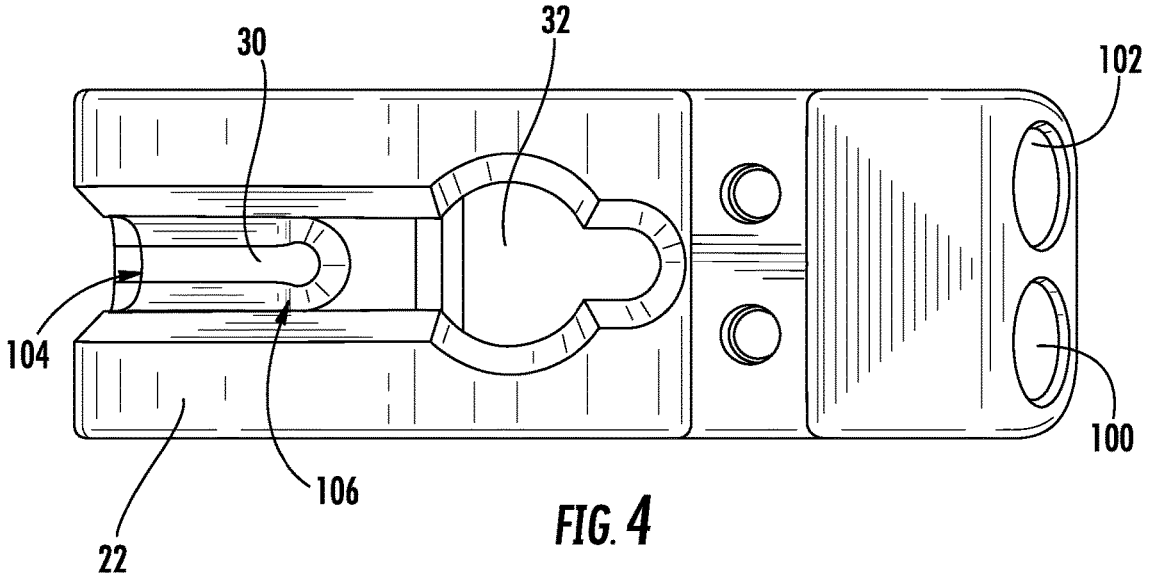
FIG. 4 is an inclined view of the rope connector base of FIG. 2.

The rope connector base 22 of the connector 12 is shown with reference to both FIGS. 2 and 4. A first opening 100 extends through the rope connector base 22 so that the outer rope 20 may extend completely through the rope connector base 22. As previously described, the outer rope 20 can be looped about itself and then brought back to the rope connector base 22. The outer rope 22 may then be moved through and out of the opening 102 such that the outer rope 20 makes two passes through the rope connector base 22. The outer rope 20 can be engaged or attached to the rope connector base 22 so that it does not move relative to the rope connector base 22. In this regard, the rope connector base 22 can have an attachment that clamps onto or otherwise is affixed to either one of or both of the passes of the outer rope 20. Additionally, or alternatively, the outer rope 20 can be crimped or attached to itself on opposite sides of the rope connector base 22 so that its position with respect to the rope connector base 22 is therefore fixed. There may be enough frictional resistance between the outer rope 20 and the rope connector base 22 so that the outer rope 20 does not easily move through the openings 100, 102.

The rope connector base 22 defines a slot 30 through an outer surface that allows access to the interior of the rope connector base 22. The slot 30 extends along a generally flat section of the outer surface of the rope connector base 22 and then extends along a curved section of the outer surface of the rope connector base 22. The slot 30 terminates on an end of the rope connector base 22 that has a flat outer surface such that the slot 30 may terminate at the junction of the curved outer surface and the flat end surface of the rope connector base 22. The slot 30 may have an expanded portion 32 that is located at the substantially flat surface of the outer surface of the rope connector base 22 and is between the terminal ends of the slot 30. The expanded portion 32 is expanded such that the width of the slot 30 is increased at the expanded portion 32 from that in other areas of the slot 30. The width of the slot 30 may be the direction perpendicular to the direction of extension of the slot 30 from one end to the other along the outer surface of the rope connector base 22. The expanded portion 32 may have a concave shape on either end, but it is to be understood that this shape of the expanded portion 32 is only exemplary and that other shapes are possible in accordance with other exemplary embodiments. Also, although described as being located along some portion of the length of the slot 30, the expanded portion 32 may be located at the terminal end of the slot 30 in other arrangements. Also, although shown as having an expanded portion 32, it is to be understood that the slot 30 need not have an expanded portion 32 in other arrangements of the fall restriction device 10.

Figure 5:
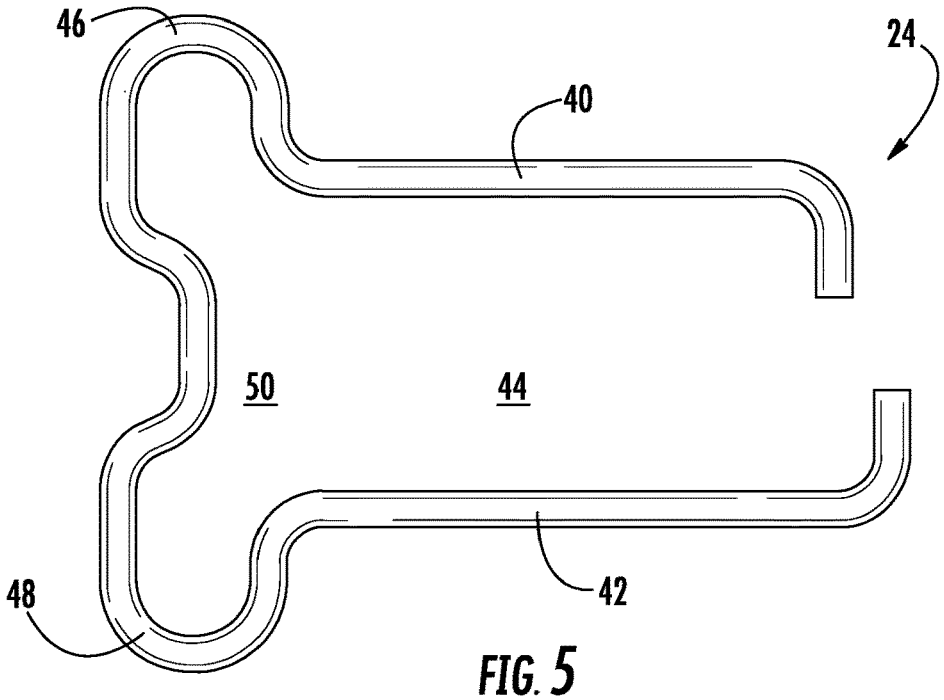
FIG. 5 is a top plan view of the spring latch of FIG. 2.

With reference to FIG. 5, the latch 24 of the connector 12 is illustrated. The latch 24 may be a single unitary piece and may have a first longitudinally extending portion 40 that is disposed opposite from a second longitudinally extending portion 42. As shown, the second longitudinally extending portion 42 is longer in the longitudinal direction than the first longitudinally extending portion 40. A longitudinal opening 44 is defined between the first and second longitudinally extending portions 40, 42. A first ear 46 extends from the first longitudinally extending portion 40 and extends outward in the lateral direction from the first longitudinally extending portion 40 with regards to a midline of the latch 24. In a similar manner, a second ear 48 extends from the second longitudinally extending portion 42 and is located outboard from the second longitudinally extending portion 42 in the lateral direction. The first and second ears 46 and 48 extend towards one another and form a feature that is indented or otherwise disposed backwards in the longitudinal direction from the extreme terminal sides of the first and second ears 46 and 48. The latch 24 may have a circular cross-sectional shape and can be arranged so that it may flex some amount in the longitudinal and/or lateral directions. The longitudinal opening 44 may extend for a greater amount in the longitudinal direction than the lateral opening 50. On the other hand, the lateral opening 50 may be longer in the lateral direction than the longitudinal opening 44. The lateral opening 50 may be sized in the lateral direction so that the first and second projections 36, 38 of the rope connector 26 may be located therein. The latch 24 can be formed so that the first longitudinally extending portion 40 is longer or shorter than the second longitudinally extending portion 42. Also, one of the portions 40 or 42 can be angled with respect to the other portion 40 or 42 and the ears 46 and 48. This angle cannot be seen in the plan view of FIG. 5, but would be evident in an elevational view of the latch 24 in that one of the portions 40 or 42 would extend upwards or downwards starting at the convergence of the portion 40 or 42 with the ear 46 or 48. This angle may allow for the latch 24 to function as a spring when the latch 24 is installed into the rope connector base 22.

Figure 6:
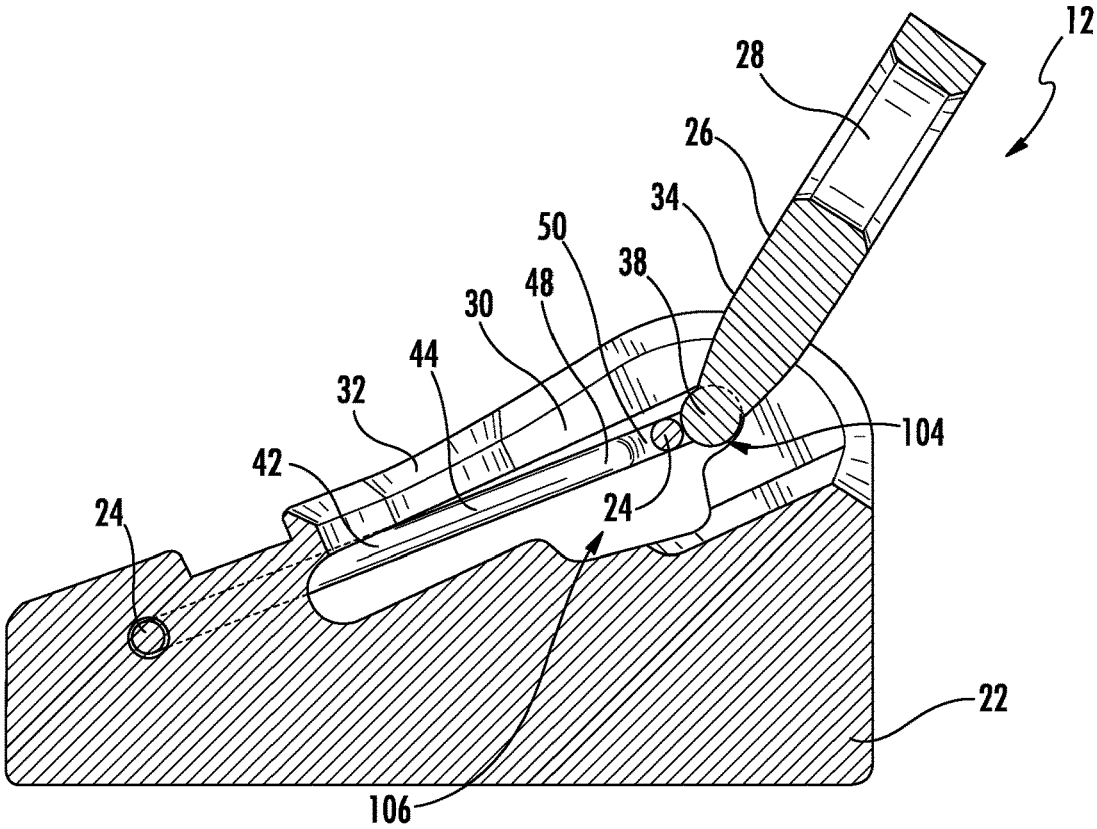
FIG. 6 is a cross-sectional view of the connector of FIG. 2 with the rope connector in an engaged position.

FIG. 6 is a cross-sectional view of the connector 12 in an engaged or locked position in which the position of the rope connector 26 with respect to the rope connector base 22 does not change. The engaged or locked position of the connector 12 is also shown with reference to the connector 12 of FIG. 1. The rope connector base 22 has openings into which the terminal ends of the first and second longitudinally extending portions 40, 42 are disposed. The rope connector base 22 also has an open interior portion that receives other portions of the latch 24 such as the first and second longitudinally extending portions 40, 42 and the first and second ears 46, 48. The rope connector base 22 has an internal geometry that defines a first pocket 104 into which the first and second projections 36, 38 of the rope connector 26 are disposed. The base 34 of the rope connector 26 extends from the projections 36, 38 out of the slot 30. The first and second ears 46, 48 of the latch 24 may engage the rope connector 26 at the projections 36, 38 and the rope connector 26 may be held into the locked/engaged position. In the engaged position, the rope connector 28 remains stationary with respect to the base 22 and the inner and outer ropes 18, 20 are connected to one another by way of the connector 12.

Figure 7:
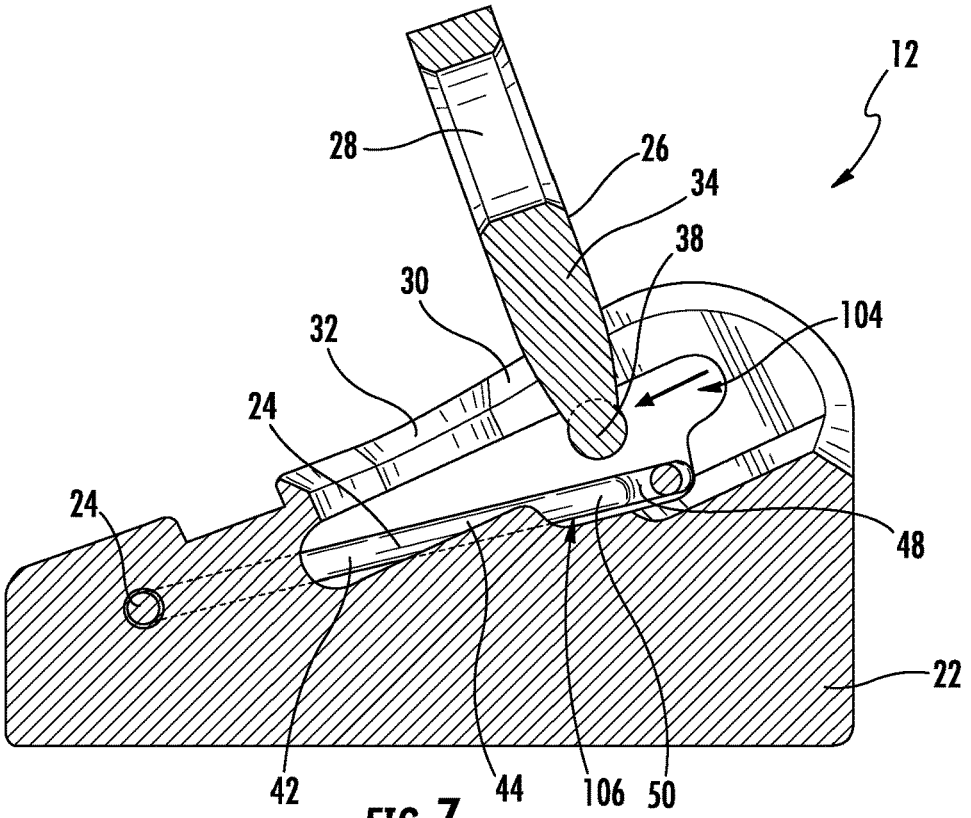
FIG. 7 is a cross-sectional view of the connector of FIG. 6 with the rope connector moved from the engaged position with the spring latch depressed.

When the climber 84 desires to disengage the connector 12 such that the inner and outer ropes 18, 20 are no longer engaged to one another through the connector 12, the climber 84 will move the rope connector 26 from the engaged/locked position. With reference now to FIG. 7, in order to disengage the connector 12 the climber 84 will first grasp one of the ears 46 or 48. The climber 84 will apply force to one of the ears 46 or 48 so as to pivot the ears 46, 48 into the second pocket 106 of the rope connector base 22. The latch 24 may thus pivot about the terminal ends of the first and second longitudinally extending portions 40, 42 that are disposed within the openings of the rope connector base 22. The latch 24 may pivot about the aforementioned terminal ends due to the fact that the latch 24 is internally flexible. This flexibility may be due to the length of the extending portions 40, 42 along with their circumference and the material making up the portions 40, 42. The latch 24 thus has internal flexibility in that it can be flexed some degree upon the application of force. Release of this force will cause the latch to spring back to its initial position shown in FIG. 6. Also as stated, internal biasing/flexibility of the latch 24 may be achieved in having one of the portions 40 or 42 at an angle with respect to the other and with respect to the first and second ears 46 and 48.

The arrangement in FIG. 7 shows the second ear 48 pivoted so as to be disposed within the second pocket 106. Movement of the latch 24 in this manner provides room for the first and second projections 36, 38 of the rope connector 26. The latch 24 in FIG. 7 is pivoted in that force is applied at the first or second ears 46, 48 to flex the latch 24 in the position shown as the terminal ends of the portions 40, 42 remain stationary with respect to the rope connector base 22. The latch 24 may thus be arranged as a spring in that it is capable of being moved from its initial position by a force, and then can return to its initial position when the force is removed. The climber 84 may move the rope connector 26 so that the first and second projections 36, 38 are moved from the first pocket 104 and above the first and second ears 46, 48 so that the latch 24 is between the first and second projections 36, 38 and the second pocket 106. This movement of the rope connector 26 relative to the rope connector base 22 may be movement along the slot 30 such that the rope connector 26 rotates about the first and second projections 36, 38 and likewise moves along the slot 30 back towards the expanded portion 32. Once the rope connector 26 has moved a sufficient amount, the climber 84 may release the first or second ears 46, 48 so as to allow the latch 24 to return to its at rest position that was previously illustrated with respect to FIG. 6. The latch 24 will spring back to its FIG. 6 at rest position due to the internal biasing force of the latch 24 as the latch 24 is internally biased to the FIG. 6, at rest position. The first and second projections 36, 38 at this point will be disposed through the lateral opening 50 such that the first and second projections 36, 38 will be moved underneath the latch 24 such that the latch 24 will be between the first and second projections 36, 38 and the area of the slot 30 through which the base 34 extends. The distance from the first longitudinally extending portion 40 to the second longitudinally extending portion 42 is greater than the distance from the terminal end of the first projection 36 to the terminal end of the second projection 38.

The climber 84 may continue to slide the rope connector 26 along the slot 30 until the base 34 is located within the expanded portion 32. During this sliding, the climber 84 does not need to engage or touch the first or second ears 46, 48. The first and second projections 36 and 38 may be between the first and second longitudinally extending portions 40 and 42.

Figure 8:
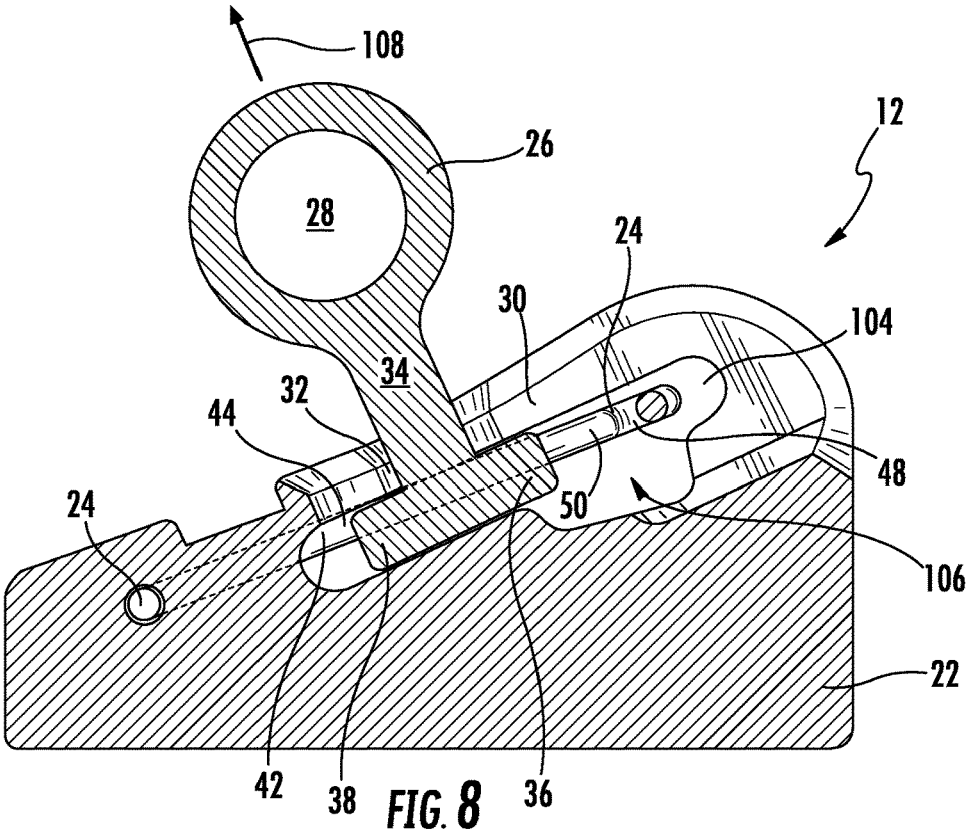
FIG. 8 is a cross-sectional view of the connector of FIG. 6 with the rope connector rotated 90 degrees just prior to removal from the rope connector base.

FIG. 8 shows the rope connector 26 disposed through the expanded portion 32 of the slot 30. The climber 84 will rotate the rope connector 26 so that the first and second projections 36, 38 are aligned with the slot 30. This rotation may be 90 degrees such that the rope connector 26 is rotated 90 degrees from the position shown in FIG. 7 to the position shown in FIG. 8 with respect to the rope connector base 22. In accordance with other exemplary embodiments, the rotation of the rope connector 26 relative to the rope connector base 22 may be from 0-45 degrees, from 45-90 degrees, from 1.20-270 degrees, or up to 360 degrees.

The expanded portion 32 accommodates the size of the base 34 such that the width and depth of the base 34 is accommodated in the expanded portion 32 to allow the rope connector 26 to be rotated at this location relative to the rope connector base 22. The climber 84 may then lift the rope connector 26 from the rope connector base 22 by pulling the rope connector 22 upwards through the slot 30 as indicated by arrow 108 in FIG. 8. The first and second projections 36, 38 will be disposed within the longitudinal opening 44 of the latch 24 and due to its size no interference will be created between the latch 24 and the first and second projections 36, 38. In a similar manner, as the first and second projections 36, 38 are arranged lengthwise relative to the slot 30, the first and second projections 36, 38 will have clearance through the slot 30 on either side of the expanded portion 32 to allow the first and second projections 36, 38 to be removed from the rope connector base 22. Once the rope connector 26, and consequently the inner rope 18 that extends through the aperture 28, is removed from the rope connector base 22, the climber 84 may move past any obstruction on the utility pole 86 without interference from the presence of the fall restriction device 10.

Once the climber 84 has negotiated any obstacle on the utility pole 86 he or she may desire to reattach the fall restriction device 10. This reattachment may involve the reconnection of the rope connector 26 to the rope connector base 22 such that the rope connector 26 is once again placed into the locked or engaged position. The unlocked or disengaged position of the rope connector 26 may be associated with the state in which the rope connector 26 is moved out of engagement with the rope connector base 22 and in effect the rope connector 26 and the attached inner rope 18 are disengaged from the rope connector base 22. In order to reattach these components, the climber 84 may reinsert the rope connector 26 back into the rope connector base 22 such that the rope connector 26 is positioned and moved in a direction 180 degrees opposite from the arrow 108 in FIG. 8. This reinsertion will not move the latch 24 from the position shown in FIG. 8 as the first and second projections 36, 38 have sufficient clearance to move through slot 30 and the lateral opening 50 so as to be located below the latch 24. The expanded portion 32 allows for the base 34 to be rotated 90 degrees. After this rotation, the climber 84 may then slide the rope connector 26 along the slot 30. In this regard, the base 34 will move past the expanded portion 32 and into the portion of the slot 30 that is between the expanded portion 32 and the first pocket 104 as the rope connector 26 is moved towards the first pocket 104. Likewise, as the rope connector 26 is slid along the rope connector base 22, the terminal ends of the projections 36 and 38 are free to move relative to the first and second longitudinally extending portions 40 and 42 as there is sufficient clearance between the portions 40 and 42.

The climber 84 does not need to grasp or otherwise touch the first or second ears 46, 48 of the latch 24. As the rope connector 26 is moved towards the first pocket 104, the first and second projections 36, 38 will remain below and within the latch 24 such that they are below and within the first and second longitudinally extending portions 40, 42. The first and second projections 36, 38 will be moved along the first and second longitudinally extending portions 40, 42 until the first and second projections 36, 38 move into the lateral opening 50. At this point, the stem portion of the rope connector 26, that is the base 34 portion of the rope connector 26 that engages the first and second projections 36 and 38, engages the indented portion of the latch 24. This stem portion of the rope connector 26 is immediately above the second projection 38 shown in FIG. 9 and is inclined or angled. The indented portion of the latch 24 is the central portion of the this component in the laternal direction and is the component between the two ears 46 and 48. This engagement causes the latch 24 to be pivoted about its connection to the rope connector base 22 at the pivot point at the terminal ends of the portions 40 and 42. Once the first and second projections 36, 38 are moved towards the first and second ears 46, 48, the first and second projections 36, 38 will be inserted into the lateral opening 50. Continued movement of the rope connector 26 towards the first pocket 104 will cause the first and second projections 36, 38 to move above the latch 24. In this regard, the first and second projections 36, 38 will be closer to the slot 30 than the latch 24. Due to the geometry of the various components, the climber 84 will not need to engage the ears 46, 48 of the latch 24 to move the latch 24 when the rope connector 26 is moved towards the engaged or locked position.

Figure 9:
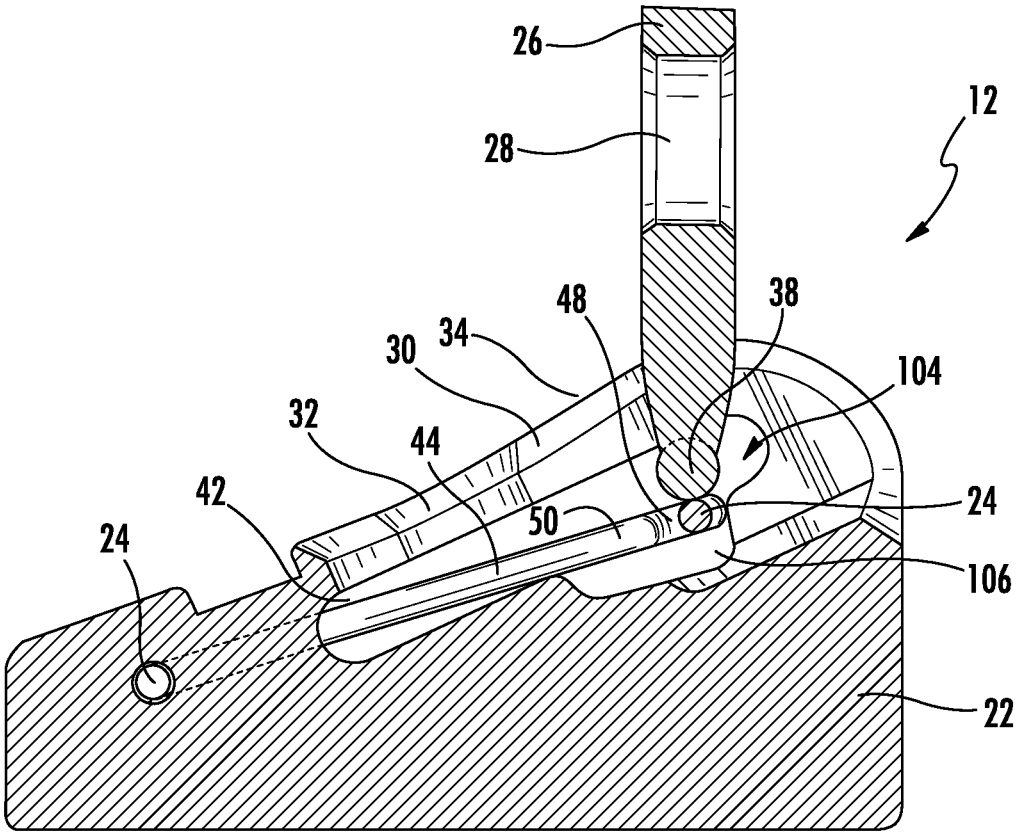
FIG. 9 is a cross-sectional view of the connector of FIG. 6 with the rope connector being moved back into the engaged position just prior to entering the engaged position.

FIG. 9 shows the rope connector 26 at an intermediate returning position before it is moved back into the locked or engaged position. Here, the first and second projections 36, 38 are located above the second pocket 106 and engage the indented portion of the latch 24, and continued movement of the rope connector 26 will cause the spring 24 to move downward towards the second pocket 106. As the rope connector 26 curves about the slot 30, the latch 24 is pivoted downward towards the second pocket 106 until the first and second projections 36, 38 extend completely through the lateral opening 50 and become placed between the latch 24 and the slot 30 as illustrated in FIG. 9. The first and second projections 36, 38 will then subsequently be placed into the first pocket 104 and the latch 24 will engage the first and second projections 36, 38 in order to help prevent the first and second projections 36, 38 from moving out of the first pocket 104. The rope connector 26 is thus placed into the locked or engaged position shown with reference back to FIG. 6. Disengagement and locking of the rope connector 26 with respect to the connector base 22 may be accomplished quickly and easily by the climber 84 through minimum manipulation of the fall restriction device 10 and may be accomplished in cold and icy conditions while wearing heavy gloves as a minimum of grasping, turning and moving of the rope connector 26 is needed. The rope connector 26 may thus be engaged and disengaged through being slid within the slot and rotated 90 degrees. However, it is to be understood that other arrangements of the fall restriction device 10 are possible in which the rope connector 26 is engaged and/or disengaged by being slid and then rotated any amount. For example, rotation from 5 to 20, from 20 to 30, from 30 to 45, from 45 to 120, or up to 360 degrees of rotation may be employed in accordance with other exemplary embodiments.

With reference to FIG. 2, a retainer 82 may be present in order to retain the latch 24 to the rope connector base 22. The retainer 82 may be retained within a pocket of the rope connector base 22 and can be used to restrict the amount of movement of the latch 24 in the lateral direction with respect to the rope connector base 22. The terminal ends of the portions 40 and 42 need not be welded or otherwise rigidly attached to the rope connector base 22, but the ends of the portions 40 and 42 may be retained in a stationary position with respect to the rope connector base 22 by the retainer 82 while portions of the latch 24 remote from the retainer 82 can pivot with respect to the retainer 82 and the base 22. A pair of spikes 80 may be disposed through the retainer 82 and can engage the rope connector base 22. The spikes 80 function to assist the climber 84 in grasping onto the utility pole 86 in that the spikes 80 may grip into the utility pole 86. The spikes 80 may extend through the retainer 82 and thus may function not only to aid in gripping of the utility pole 86 by the connector 12 but also to retain the retainer 82 onto the rope connector base 22.

Figure 16:
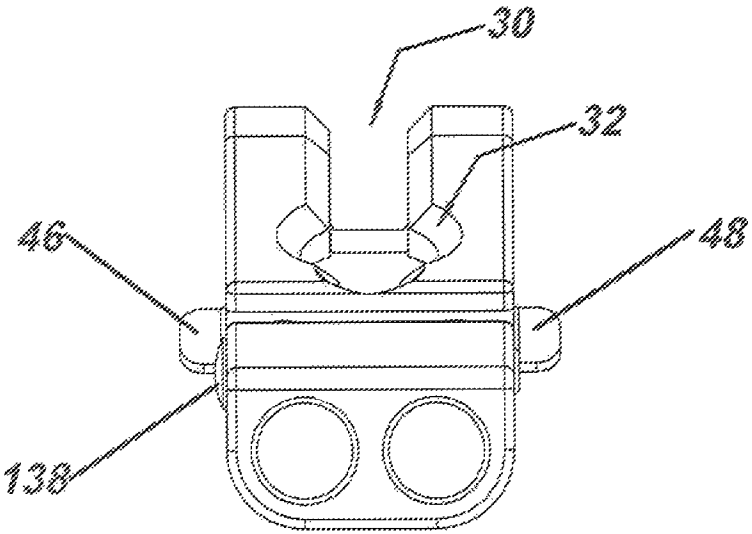
FIG. 16 is a front view of the connector of FIG. 15.

An alternative exemplary embodiment of the connector 12 is illustrated with reference to FIGS. 15-19. This arrangement is similar to certain previously described embodiments of the connector 12. However, the latch 24 is configured in a different manner from some of those previously described. The latch 24 has a gate 136 that is mounted to and can pivot with respect to the rope connector base 22. With reference to FIG. 16, the latch 24 has first and second ears 46 and 48 that extend in the lateral direction beyond the sides of the rope connector base 22. In some arrangements, only a single one of the ears 46 or 48 is present. The provision of two ears 46 and 48 provides the user with the flexibility of actuating the latch 24 from either side of the rope connector base 22. The gate 136 may be located between the lateral sides of the rope connector base 22 so that no portion of the gate 136 extends beyond the lateral sides in some embodiments.

Figure 17:
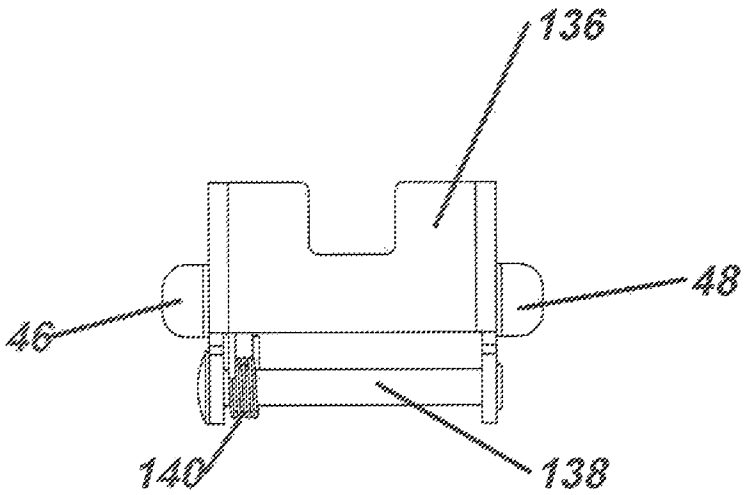
FIG. 17 is a front view of the latch of FIG. 15.

FIG. 17 shows a front view of the latch 24. The gate 136 has a generally flat outer surface that can be rectangular in shape. The gate 136 may be variously shaped in other arrangements and need not have an outer surface that is flat. The flat surface of the gate 136 has an indentation in its center that extends downward in the vertical direction as shown in FIG. 17. The gate 136 may be a single, unitary component or may be made up of several different components. For example, the ears 46 and 48 may be separate from the gate 136 and attached thereto by way of welding, pins, rivets, or mechanical fasteners.

Figure 18:
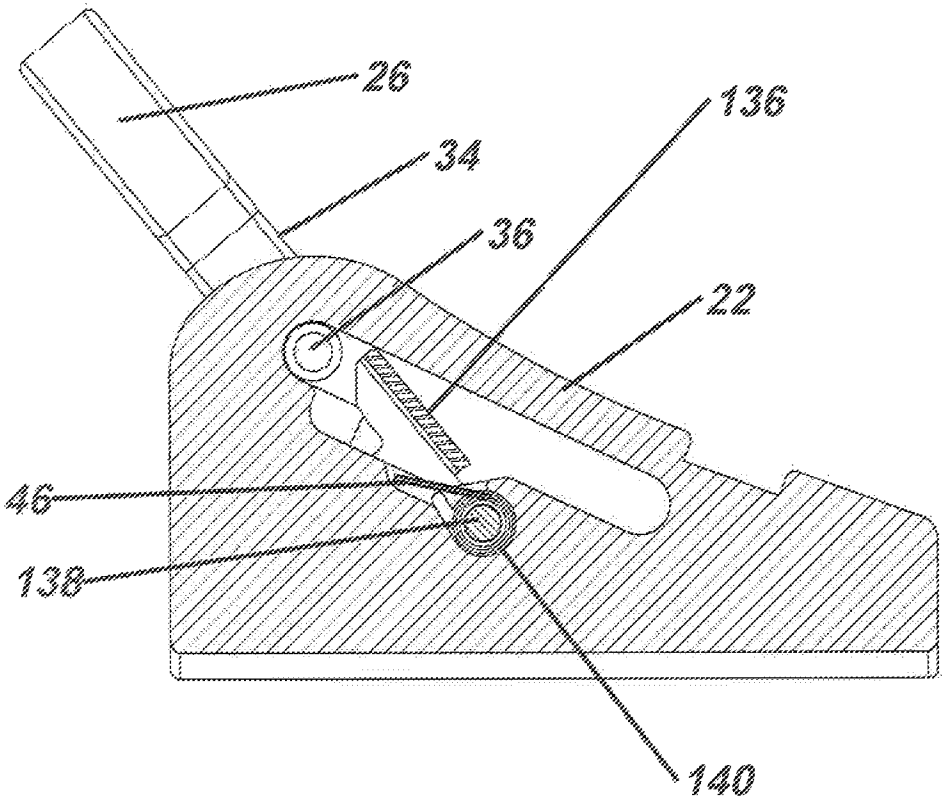
FIG. 18 is a cross-sectional view of the connector of FIG. 15 with the rope connector in the engaged position.

With reference now to FIG. 18, the latch 24 is mounted to the rope connector base 22 by a pivot 138 that is a rivet. The pivot 138 may be a single pin, a pair of pins, or a live axle in accordance with various exemplary embodiments. The pivot 138 may be attached to the rope connector base 22 so that it does not rotate with respect to the rope connector base 22. In other arrangements, the pivot 138 may rotate with respect to the rope connector base 22 and thus may be stationary with respect to certain portions of the latch 24 such as the gate 136. The latch 24 may include a spring 140 through which the pivot 138 is disposed. The spring 140 may have a tab that engages the rope connector base 22, and may have a tab that engages the gate 136. The spring 140 can be arranged so that it biases the latch 24 to the closed/engaged position. The latch 24 is illustrated in the engaged position in FIG. 18. As shown, the gate 136, and in some arrangements the entire latch 24, may be located so that it is not below the expanded portion 32. In this regard, in some arrangements all of the latch 24 may be located with respect to the rope connector base 22 so that it is not below the expanded portion 32.

The rope connector 26 is also shown in FIG. 18 and is in the engaged position. The first and second projections 36 and 38 may engage the gate 136 and can be held by the gate 136 in the engaged position. However, as shown in FIG. 18 the first and second projections 36 and 38 are not actually touching the gate 136 but are spaced some small distance therefrom. The rope connector 26 may have some amount of movement in the engaged position with respect to the rope connector base 22, but is still prevented from moving out of the engaged position due to the presence of the gate 136. The rope connector 26 may not engage the flat outer surface of the gate 136 previously described when in the engaged position, but may engage a different portion of the gate 138. The gate 138 holds the rope connector 26 in the engaged position and prevents the rope connector 26 from moving relative to the rope connector base 22. The spring 140 biases the gate 136 against the rope connector 26 in the engaged position.

Figure 19:
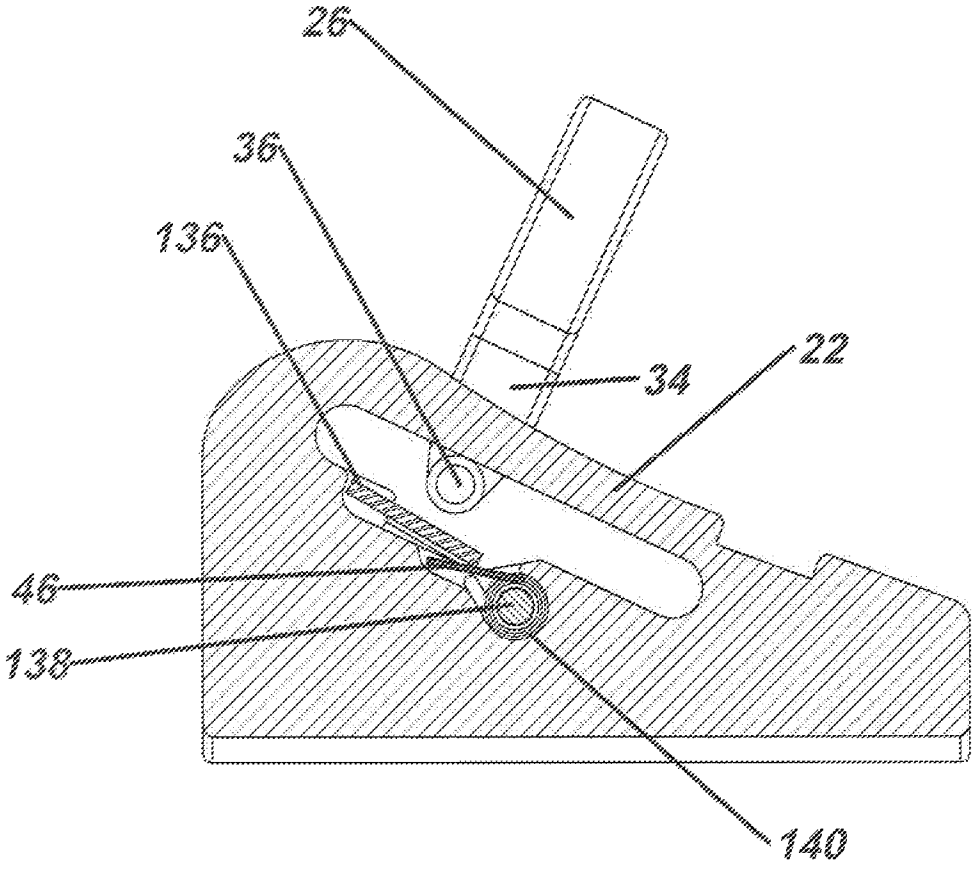
FIG. 19 is a cross-sectional view of the connector of FIG. 15 with the rope connector in the disengaged position.

When the user desires removal of the rope connector 26 from the rope connector base 22, the user may push one or both of the ears 46 and/or 48 to cause the latch 24 to pivot with respect to the rope connector base 22. The user will apply force against the biasing direction of the spring 140 to cause the latch 24 and the gate 136 of the latch 24 to pivot. FIG. 19 shows the latch 24 pivoted by the user out of the engaged position of FIG. 18. The latch 24 is rotated in the counterclockwise direction from FIG. 18 to FIG. 19 and the gate 136 is moved farther away from the expanded portion 32. The latch 24 when pivoted provides clearance for the projections 36 and 38 to move relative to the rope connector base 22. The base 34 is free to move along the slot 30, and when moved to the expanded portion 32, the rope connector 26 can be rotated and removed as previously described. The latch 24 may continue to be depressed through this whole removal process, or the user can release the latch 24 and cause it to move back to the engaged position through the spring 140 bias once the projections 36 and 38 have moved a sufficient distance to clear the gate 136.

In order to reconnect the rope connector 26, the user may insert the projections 36 and 38 through the expanded portion 32 and rotate the rope connector 26 in the same manner described with respect to previous embodiments. The rope connector 26 may be slid along the slot 30 towards the engaged position. Once the projections 36 and 38 engage the flat outer surface of the gate 138, continued force applied onto the rope connector 26 by the user will cause the spring 140 bias to be overcome thus forcing the latch 24 out of the engaged position. The projections 36 and 38 will be pushed past the gate 138 and moved into the engaged position as shown in FIG. 18. Once moved past the flat outer surface of the gate 138, the latch 24 will spring back to its engaged position to lock the rope connector 26 in place. The user need not apply any force to the ears 46 or 48 to cause the rope connector 26 to be connected to the rope connector base 22. However, the user may depress the latch 24 by pushing on the ears 46 and/or 48 in some instances if desired to clear the way for the projections 36 and 38 to be moved into the engaged position. Although the projections 36 and 38 have been described as engaging the flat outer surface of the gate 136, it is to be understood that other portions of the rope connector 26 may additionally or alternatively engage other portions of the latch 24. For example, the base 34 may engage the gate 136 or some other portion of the latch 24 when being moved into the engaged position to urge the latch 24 out of the way.

Figure 10:
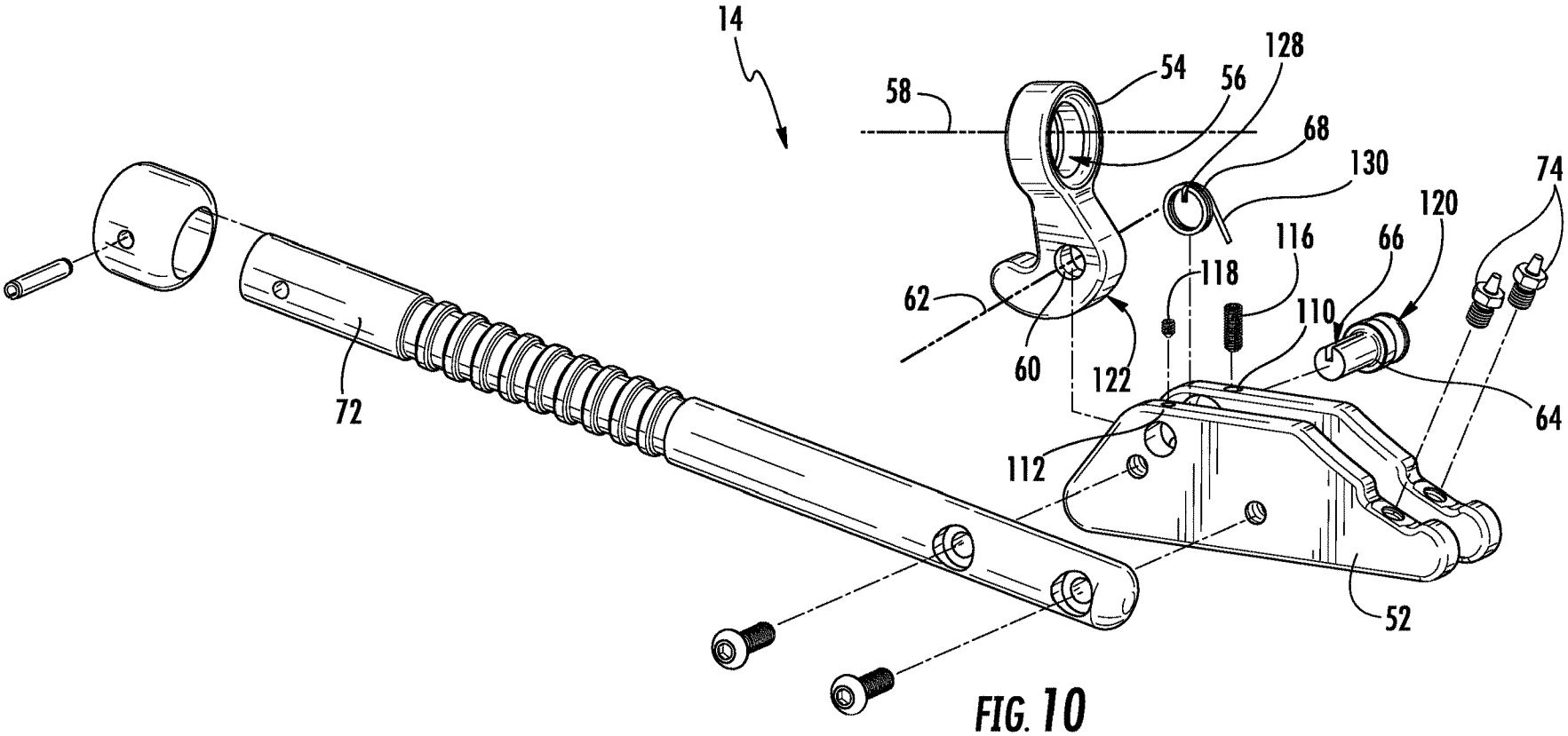
FIG. 10 is an exploded assembly view of a rope grab in accordance with s one exemplary embodiment.

The fall restriction device 10 may also be provided with a rope grab 14. The position of the rope grab 14 with respect to the outer rope 20 may be adjusted by the user 84 before beginning his or her ascent of the utility pole 86. The positioning of the rope grab 14 may be made such that a desired length of the outer rope 20 is maintained between the connector 12 and the rope grab 14 as dictated by the size of the utility pole 86. The position of the rope grab 14 may then be locked onto the outer rope 20 such that the outer rope 20 does not slide through the rope grab 14. The remaining portion of the outer rope 20 that is not between the connector 12 and the rope grab 14 may be tied off so as not to interfere with the climbing process or may remain as is if the climber 84 is not hindered by its presence. The inner rope 18 will engage the rope grab 14 and may be capable of moving through the rope grab 14. FIG. 10 is an exploded view of the rope grab 14 in accordance with one exemplary embodiment. The rope grab 14 includes a rope grab body 52 onto which the handle 72 may be disposed. The handle 72 may be bolted onto the rope grab body 52 or could be integrally formed therewith in accordance with various exemplary embodiments. The handle 72 affords the climber 84 with a mechanism for grasping and manipulating the rope grab 14 when ascending or descending the utility pole 86. A pair of spikes 74 may be inserted into the rope grab body 52 and retained thereon through a threaded connection. As previously discussed, the spikes 74 will aid the climber 84 in causing the rope grab 14 to better grasp onto the utility pole 86 by being inserted into the utility pole 86.

Figure 11:
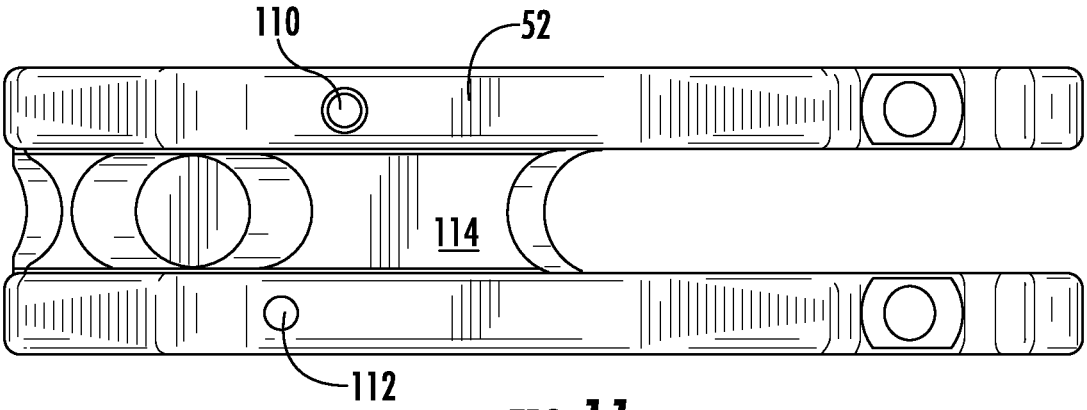
FIG. 11 is a top plan view of the rope grab body of FIG. 10.

The rope grab body 52 is shown in greater detail in FIG. 11. The rope grab body 52 may be made of a pair of halves that are connected to one another through a bottom portion 114. The pair of halves are spaced from one another such a distance to allow the outer rope 20 to extend there through. The rope grab body 52 includes a hole 110 on an upper surface of one of the halves, and a hole 112 on the upper surface of the opposite half, and the holes 110, 112 are spaced from one another such that they are not exactly opposite one another. The holes 110, 112 do not extend all the way through their respective halves of the rope grab body 52. With reference back to FIG. 10, the rope grab 14 may also include a rope grab shaft 64 that is disposed through aligned apertures through both of the halves of the rope grab body 52 such that the rope grab shaft 64 is positioned inside of the rope grab body 52. The rope grab shaft 64 has a slot 66 that extends generally in the direction from one of the halves of the rope grab body 52 to the other half of the rope grab body 52. The slot 66 is also directed so as to face upwards with respect to the rope grab body 52. The slot 66 is aligned with the hole 112 of one of the halves of the rope grab body 52. A set screw 118 is disposed through the hole 112 and extends into the slot 66. The presence of the set screw 118 will prevent the rope grab shaft 64 from rotating about its axis. The set screw 118 may be threaded into the hole 112 for attachment. The rope grab shaft 64 may also have a groove 120 that is aligned with the hole 110. The hole 110 is offset from the center of the rope grab shaft 64 such that the hole 110 does not extend any direction perpendicular to the axis of rotation of the rope grab shaft 64. A set screw 116 is disposed through the hole 110 and can be threadingly engaged therein. The set screw 116 may extend into the groove 120 of the rope grab shaft 64 in order to secure the rope grab shaft 64 onto the rope grab body 52. The set screws 116, 118 may thus retain the rope grab shaft 64 to the rope grab body 52 and prevent the rope grab shaft 64 from rotating with respect to the rope grab body 52 but cause the rope grab shaft 64 to be attached to the rope grab body 52.

Figure 12:
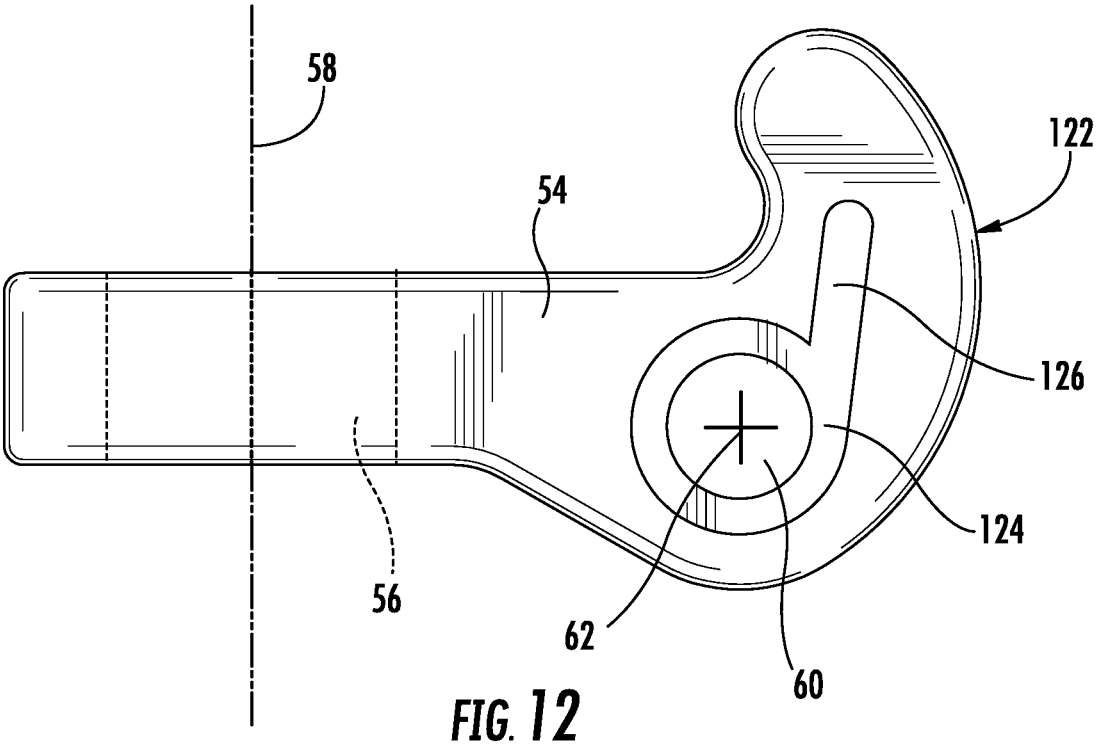
FIG. 12 is a top plan view of the torsion cam of FIG. 10.

The rope grab 14 may also include a torsion cam 54. With reference both to FIGS. 10 and 12, the torsion cam 54 defines a rope aperture 56 through which the inner rope 18 may be disposed. The inner rope 18 may move relative to the torsion cam 54 such that the inner rope 18 moves through the rope aperture 56. The torsion cam 54 also defines a cam surface 122 that is used for engaging and disengaging the outer rope 20. The torsion cam 54 may be a 90 degree torsion cam in accordance with certain exemplary embodiments. The torsion cam 54 has a torsion cam pivot aperture 60 that has a torsion cam pivot aperture axis 62. The rope grab shaft 64 may be disposed through the torsion cam pivot aperture 60 and the torsion cam 54 may rotate about the torsion cam pivot aperture axis 62 such that the torsion cam 54 rotates relative to the rope grab shaft 64 and the rope grab body 52. The rope aperture 56 has a rope aperture axis 58.

The rope aperture axis 58 is oriented at an angle of 90 degrees with respect to the torsion cam pivot aperture axis 62. In this regard, the torsion cam 54 is a 90 degree torsion cam because the rope aperture 54 is oriented at 90 degrees to the axial direction of pivoting of the torsion cam 54. However, it is to be understood that in accordance with other exemplary embodiments that the rope aperture axis 58 is parallel to the torsion cam pivot aperture axis 62 such that the torsion cam 54 is not a 90 degree torsion cam.

The torsion cam 54 defines a pocket 124 at the torsion cam pivot aperture 60. Although the torsion cam pivot aperture 60 is a through aperture, the pocket 124 is not a through pocket but only extends partway through the torsion cam 54. The pocket 124 has an elongated portion 126 that extends from a generally circular portion of the pocket 124 that is coaxial with the torsion cam pivot aperture 60. The pocket 124 is designed so as to receive a rope grab spring of the rope grab 14. The rope grab spring 68 is a coil spring that has a first tab 128 and a second tab 130. The rope grab spring 68 may be inserted into the pocket 124 such that the second tab 130 is received within the portion 126 of the pocket 124. The coiled portion of the rope grab spring 68 is retained in the pocket 124 and is coaxial with torsion cam pivot aperture axis 62. The first tab 128 is retained within the slot 66 of the rope grab shaft 64. The rope grab spring 68 functions to bias the torsion cam 54 to a closed position about the rope grab body 52.

Figure 13:
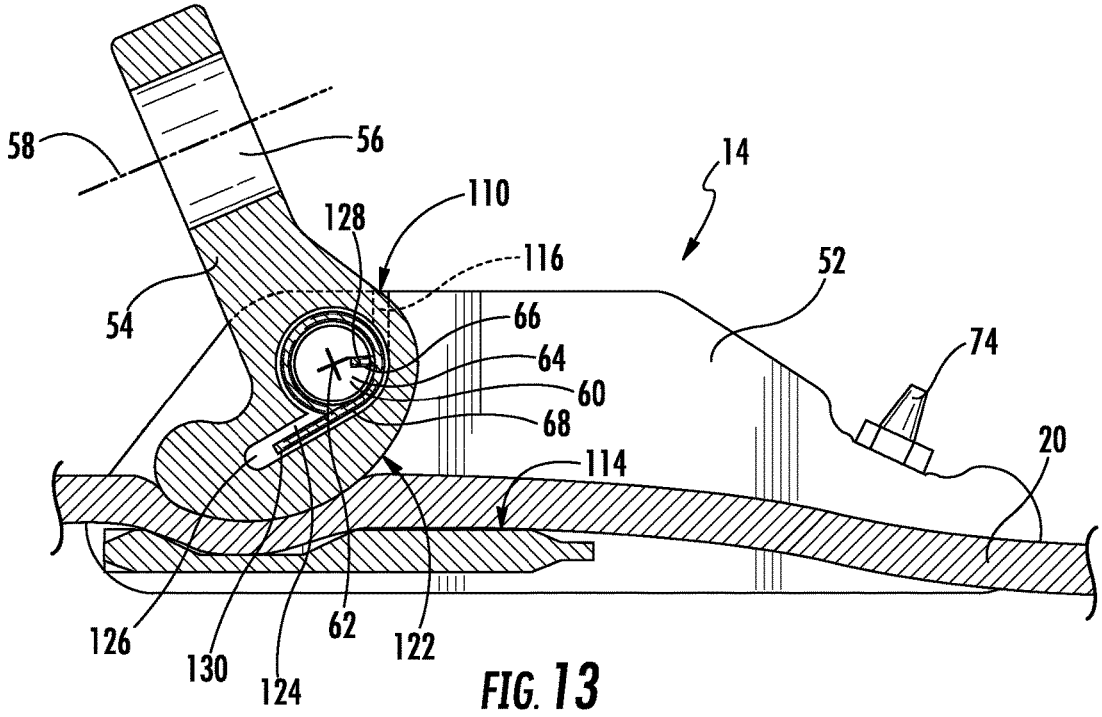
FIG. 13 is a cross-sectional view of the rope grab with the torsion cam in an engaged/locked position in which the rope is held to the rope grab body.

FIG. 13 shows the torsion cam 54 in a closed or locked position. Here, the outer rope 20 extends through the rope grab body 52 and is held thereon through engagement with the cam surface 122 of the torsion cam 54. The outer rope 20 is squeezed between the cam surface 122 and the bottom portion 114 of the rope grab body 52 such that the outer rope 20 is prevented from moving through the rope grab body 52. In the closed position, the rope grab 14 is locked onto the outer rope 20 and the distance of the working length of the outer rope 20 is fixed. The rope grab spring 68 functions to draw the cam surface 122 against the outer rope 20, and the outer rope 20 cannot be inadvertently disengaged. The cam surface 122 may be a smooth surface or may have a jagged geometry that may aid in gripping and holding the outer rope 20.

Figure 14:
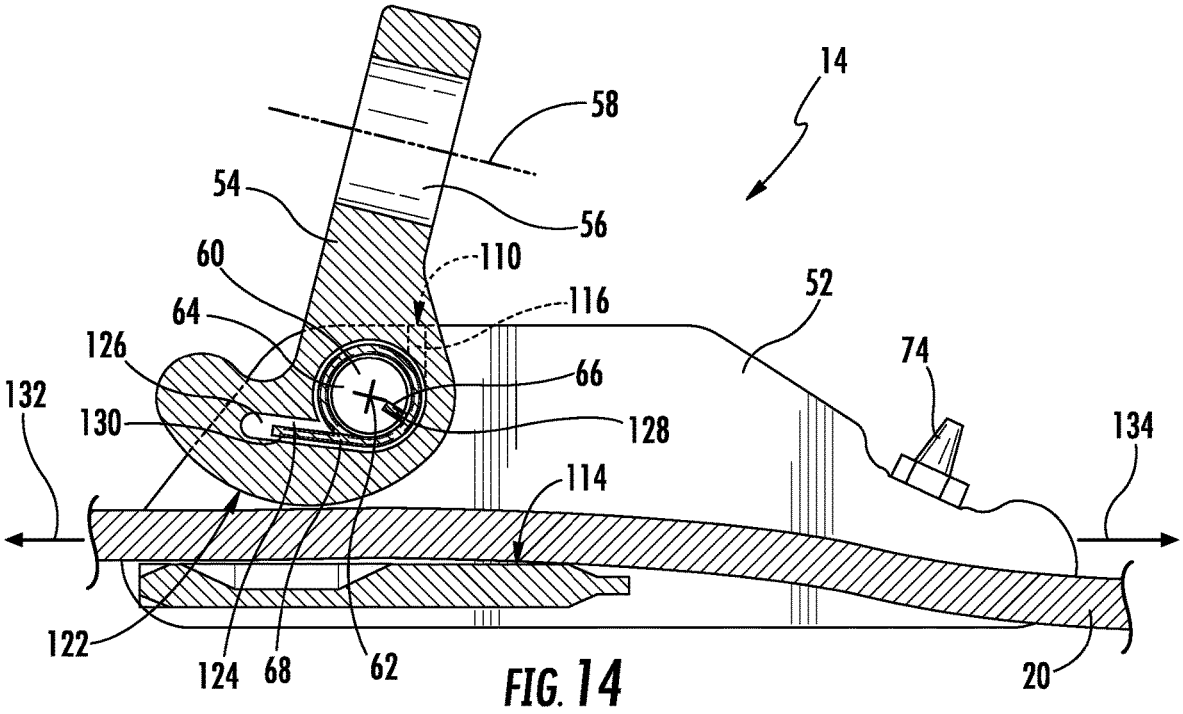
FIG. 14 is a cross-sectional view of the rope grab with the torsion cam in a disengaged/unlocked position in which the rope is not held against the rope grab body and is free to move relative to and through the rope grab body.
Figure 15:
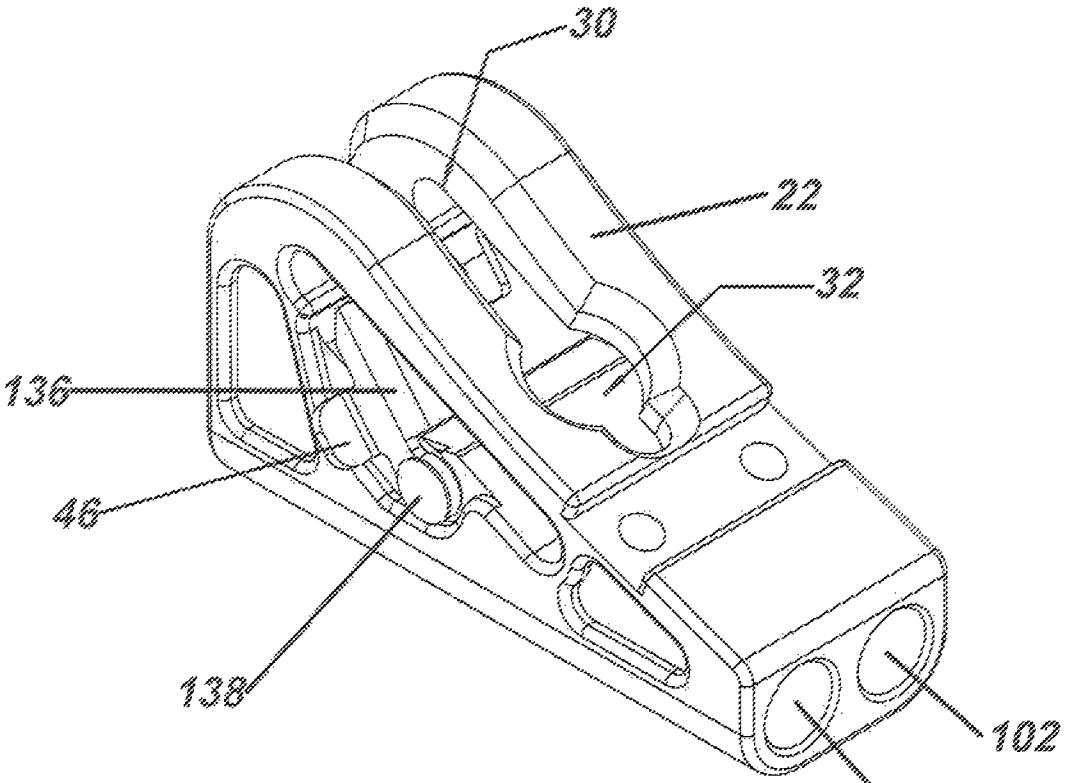
FIG. 15 is a perspective view of a connector in accordance with an alternative exemplary embodiment.

The user 84 may grasp the torsion cam 54 and rotate the torsion cam 54 about the torsion cam pivot aperture axis 62 so that the torsion cam 54 rotates some amount relative to the rope grab body 52. With reference to FIG. 14, the torsion cam 54 has been rotated relative to its position in FIG. 13 concerning the rope grab body 52. The torsion cam 54 has been rotated to an open or unlocked position in which the cam surface 122 has been reoriented to provide sufficient clearance for the outer rope 20 to move relative to the rope grab body 52. The amount of rotation of the torsion cam 54 relative to the rope grab body 52 from the open/unlocked position to the closed/locked position may be from 5-15 degrees, from 15-25 degrees, from 25-90 degrees, or up to 270 degrees in accordance with certain exemplary embodiments.

In the open or unlocked position of the torsion cam 54, the cam surface 122 does not engage the outer rope 20 so as to force the outer rope 20 stationary between the cam surface 122 and the bottom portion 114 of the rope grab body 52. However, it is to be understood that in some arrangements that the cam surface 122 may in fact engage and provide some amount of holding between the outer rope 20 and the bottom portion 114. In the unlocked or disengaged position, the outer rope 20 may be able to be moved with respect to the rope grab body 52 in the directions illustrated by the arrows 132 and 134. The biasing of the rope grab spring 68 may be overcome by the force applied by the user 84 to the torsion cam 54 to allow the torsion cam 54 to be pivoted into the open or unlocked position. Once the climber 84 has positioned the rope grab 14 to a desired location on the outer rope 20, he or she may rotate the torsion cam 54 back into the closed or locked position shown in FIG. 13 so that the cam surface 122 again forcefully engages the outer rope 20 to lock the position of the outer rope 20 with respect to the rope grab body 52.

Although described as being locked onto the outer rope 20, the rope grab 14 may in some exemplary embodiments be arranged so that the inner rope 18 is locked and so that the outer rope 20 extends through the aperture 54. In a similar manner, the connector 12 can be arranged so that the outer rope 20 extends through the aperture 28 of the rope connector 26 and so that the inner rope 18 is instead locked in place on the rope connector base 22. It is therefore the case that the engagements between the inner and outer ropes 18 and 20 with the various portions of the connector 12 and the rope grab 14 can be interchanged in other arrangements and it is to be understood that the disclosed embodiment is presented only for sake of example. Likewise, although shown as having a rope attachment 70, it is to be understood that a second rope grab 14 may be substituted for the rope attachment 70 in accordance with other exemplary embodiments, and in yet further embodiments the rope attachment 70 can be replaced with a completely different form of attachment that is either adjustable or stationary to allow for the belt 16 to be adjustable or stationarily attached to the inner rope 18.

The fall restriction device 10 may be light in that a minimum amount of components are needed for the fall restriction device 10 to work, and the components may be made of light weight material to further reduce the amount of weight associated with the device 10. The connector 12 and the rope grab 14 may be positioned on areas of the utility pole 86 that achieve a symmetrical arrangement of the fall restriction device 10. The handles 72 and 92 may be positioned with respect to the climber 84 and the utility pole 86 so that they are symmetrical about the utility pole 86 so the weight of the fall restriction device 10 and the weight of the climber 84 and his or her clothing and carried objects are evenly distributed. In this regard, the handles 72 and 92, along with the connector 12 and rope grab 14 are situated so that the climber 84 is not pulled or otherwise weighed down to one side or the other of the utility pole 86. The forces imparted onto the climber 84 will be directed in front of him or her and will not be to the side thus making the fall restriction device 10 easier to use when climbing the utility pole 86 or when working on the utility pole 86 and not actively ascending or descending.

The arrangement of the connector 12 may make it easier for the climber 84 to attach and remove the ropes 18, 20 from one another during use of the fall restriction device 10. In this regard, the climber 84 need not perform difficult or awkward moves when disengaging or engaging the connector 12. The climber 84 need only move the latch 24 a small amount for a brief moment while sliding the rope connector 26. The rope connector 26 need only be rotated 90 degrees and pulled upward for removal. When engagement is desired, the climber 84 need only insert the rope connector 26, rotate it 90 degrees, and move the rope connector 26 relative to the rope connector base 22 to the engaged position in which the connector 12 is locked. The foregoing arrangement is easily performed by the climber 84 when on the utility pole 86. However, it is to be understood that the described method of engaging and disengaging the connector 12 is only exemplary and that other methods are possible in accordance with other exemplary embodiments of the rope restriction device 10.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed:

1. A fall restriction device, comprising:

an outer rope configured to be releasably secured at least partially around a pole distal to a wearer;

an inner rope configured to be releasably secured against said pole proximal to said wearer, said inner rope selectively attachable to said wearer;

a rope grab having a rope grab body dimensioned to permit said outer rope to pass therethrough and be selectively retained therein, and an aperture dimensioned to allow said inner rope to pass freely therethrough in operation; and a connector including:

(i) a rope connector slidably affixed to said inner rope, said rope connector having a stem extending therefrom and at least one projection at a terminal end, said stem having a longitudinal axis; and (ii) a rope connector base having a receiving slot and an interior space configured to selectively receive and restrain said rope connector, said stem and said at least one projection configured for selective insertion in said receiving slot and selective retention in said interior space, said interior space being configured to permit rotation of said stem and said at least one projection for the selective retention of said rope connector therein by rotational displacement of said at least one projection about said longitudinal axis of said stem to a position misaligned with said receiving slot;

wherein said inner rope is freely displaceable relative to said rope connector base and said rope connector is selectively engageable and fully disengageable from said rope connector base by said rotational displacement of said at least one projection about said longitudinal axis of said stem.

2. The fall restriction device of claim 1, wherein said rope connector is rotatable by said rotational displacement of said at least one projection about said longitudinal axis of said stem in the range of 5-120 degrees relative to said rope connector base to engage and fully disengage said rope connector base.

3. The fall restriction device of claim 2, wherein said rope connector is rotatable by said rotational displacement of said at least one projection about said longitudinal axis of said stem 90 degrees relative to said rope connector base to engage and fully disengage said rope connector base.

4. The fall restriction device of claim 1, wherein said rope connector further comprises first and second projections extending from said stem and are configured to retain said stem in said receiving slot to engage said rope connector base.

5. The fall restriction device of claim 4, wherein said first and second projections are configured to align with said receiving slot for insertion and removal of said rope connector from said receiving slot, and to extend beyond said receiving slot upon rotation of said first and second projections about said longitudinal axis of said stem for retention of said rope connector in said rope connector base.

6. The fall restriction device of claim 1, wherein said rope connector base further comprises a latch pivotably moveable therein and configured to selectively and releasably retain said rope connector in said rope connector base.

7. The fall restriction device of claim 6, wherein said latch is pivotably moveable relative to said receiving slot, said latch is configured to pivot away from said receiving slot to permit passage of said rope connector in said receiving slot and to pivot toward said receiving slot to restrict movement of said rope connector in said receiving slot.

8. The fall restriction device of claim 7, said latch having a surface, and said rope connector contacting said surface of said latch to pivot said latch away from said receiving slot.

9. The fall restriction device of claim 6, wherein said latch is biased against said rope connector to retain said rope connector in said rope connector base.

10. The fall restriction device of claim 6, said latch having at least one ear extending beyond a perimeter of said rope connector base and configured to be selectively actuated to enable movement of said latch.

11. The fall restriction device of claim 10, said rope connector base further comprising a pocket dimensioned to receive at least a portion of said latch when said latch is pivoted away from said slot.

12. The fall restriction device of claim 11, wherein said pocket is dimensioned to receive said at least one ear of said latch when said latch is pivoted away from said slot.

13. The fall restriction device of claim 1, further comprising a first handle at said rope grab and a second handle at said connector.

14. The fall restriction device of claim 13, wherein said rope grab and said connector are symmetrically positionable about said pole.

15. The fall restriction device of claim 1, wherein at least one of said rope grab and said connector includes a spike extending therefrom and configured to engage said pole.

16. The fall restriction device of claim 1, wherein each of said outer rope and said inner rope are load bearing.

17. The fall restriction device of claim 1, wherein said receiving slot includes an expanded portion of increased width compared to a remainder of said receiving slot.

18. The fall restriction device of claim 17, wherein said rope connector further comprises first and second projections extending from said stem, said expanded portion of said receiving slot is dimensioned to receive said first and second projections.

19. The fall restriction device of claim 1, wherein said rope connector includes an aperture dimensioned to slidably receive said inner rope.

* * * * *